US005521338A

United States Patent [19]

Shono et al.

[11] Patent Number: 5,521,338

[45] Date of Patent: May 28, 1996

[54] METHOD OF INSTALLING SOUND ABSORBING BODIES ON A SOUND INSULATION WALL AND AN INSTALLED SOUND ABSORBING BODY ASSEMBLY

[75] Inventors: Yutaka Shono, Tokyo; Masahito Watanabe, Hyogo; Kohei Yamamoto; Naoyuki Furuta, both of Tokyo, all of Japan

[73] Assignee: Nitto Boseki Co., Ltd., Japan

[21] Appl. No.: 299,099

[22] Filed: Sep. 2, 1994

[30] Foreign Application Priority Data

Mar. 14, 1994 [JP] Japan ..... 6-069103

[51] Int. Cl.[6] ..... G10K 11/00

[52] U.S. Cl. ..... 181/210; 181/284; 181/290; 52/144

[58] Field of Search ..... 181/210, 284, 181/285, 286, 290, 294, 295, 293; 52/144, 145

[56] References Cited

U.S. PATENT DOCUMENTS

| | | | |
|---|---|---|---|
| 4,214,411 | 7/1980 | Pickett | 52/144 |
| 4,899,846 | 2/1990 | Furuta et al. | 181/210 |
| 5,329,073 | 7/1994 | Shono et al. | 181/210 |

OTHER PUBLICATIONS

*Improvements of Noise Reducer*, Expressways and Automobiles, vol. 36, No. 2, pp. 39–42, Feb. 1, 1993, Express Highway Research Foundation of Japan.

*Primary Examiner*—Khanh Dang

*Attorney, Agent, or Firm*—Sixbey, Friedman, Leedom & Ferguson; Gerald J. Ferguson, Jr.; David S. Safran

[57] ABSTRACT

First, sound absorbing plates made of a hard material are fixed to both side plates of shaped steel members extending upward from a sound insulation wall at intervals that are equal to arrangement spans of the shaped steel members. Then, sound absorbing members that have been formed into a predetermined shape and length are attached to outer surfaces of the sound insulation plates.

9 Claims, 7 Drawing Sheets

METHOD OF INSTALLING SOUND ABSORBING BODIES ON A SOUND INSULATION WALL AND AN INSTALLED SOUND ABSORBING BODY ASSEMBLY

BACKGROUND OF THE INVENTION

The present invention relates to an improvement in an installation method of sound absorbing bodies that are attached, to prevent diffraction of noise sound, to the top portion of a sound insulation wall which is installed to prevent diffusion of noise sound generated in an expressway, a factory, etc.

A means for installing the above type of sound absorbing bodies to the top portion of a sound insulation wall is disclosed in "Improvements of Noise Reducer (Novel Sound Insulation Wall for Roads)" (in Japanese), Expressways and Automobiles, Vol. 36, No. 2, pp. 39–42, published by Express Highway Research Foundation of Japan on Feb. 1, 1993.

As shown in FIG. 8, in the above conventional means, preliminarily formed sound absorbing body halves D and E are connected to side plates B and C of an H-shaped steel member A that projects upward from the top face of a sound insulation wall (not shown) with weld bolts F and nuts G. (One of the side plates B and C faces a sound source.) Each of the sound absorbing body halves D and E is prepared in advance such that a sound absorbing material J such as glass wool is interposed between an inner sound insulation plate H such as a steel plate and an outer perforated plate I, and then a resulting structure is formed into a predetermined shape and length.

In the above conventional installation method, while the sound absorbing body halves D and E are preliminarily formed into a predetermined shape and length, in many cases the arrangement span of the H-shaped steel members A varies from one installation site to another. Where the arrangement span of the H-shaped steel members A does not conform to the length of the preliminarily formed sound absorbing body halves D and E, it is necessary to produce new sound absorbing body halves having suitable dimensions, or to adjust the length at an installation site. This results in ah increased cost, a complex installing operation, and other problems.

SUMMARY OF THE INVENTION

In view of the problems of the above-described conventional method, an object of the present invention is to provide an installation method which can install sound absorbing bodies which have been formed into predetermined dimensions relatively easily in an orderly manner, irrespective of the arrangement span of H-shaped steel members.

According to the invention, a method of installing, on a top portion of a sound insulation wall, sound absorbing bodies that comprise right and left halves each comprising sound insulation plates made of a hard material and sound absorbing members, the right and left halves assuming a generally symmetrical shape with respect to a vertical plane when installed, comprises the steps of:

fixing the sound insulation plates to right and left side plates of shaped steel members extending upward from the top portion of the sound insulation wall at intervals that are equal to arrangement spans of the shaped steel members; and attaching the sound absorbing members that have been formed into a predetermined shape and length to outer surfaces of the sound insulation plates.

DESCRIPTION OF THE PREFERRED EMBODIMENTS

Figure 1:
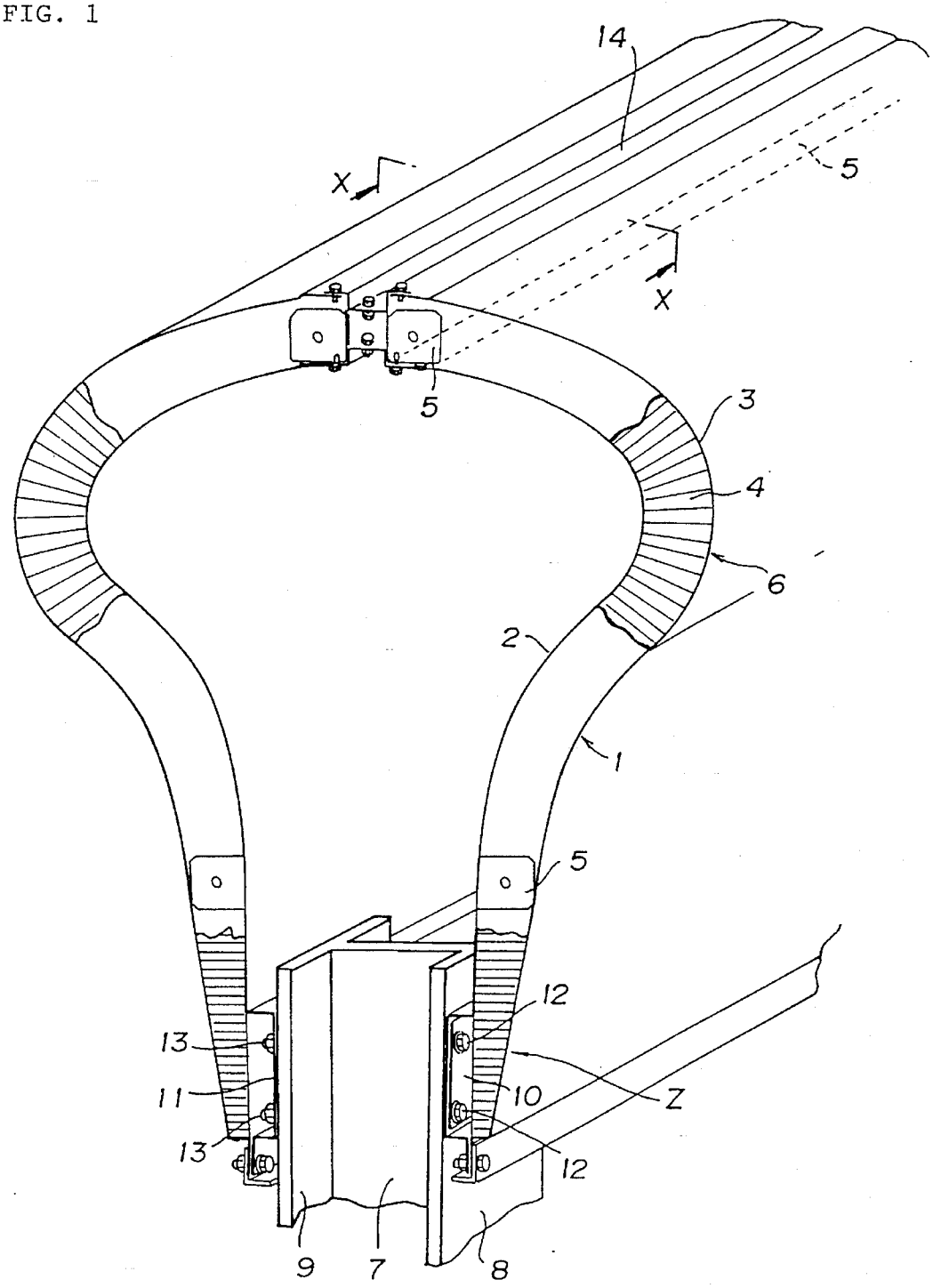
FIG. 1 is a perspective view showing a fixing structure of a sound absorbing body as installed according to the present invention.

FIGS. 1–7 show sound absorbing bodies that are attached to shaped steel members extending from the top face of a sound insulation wall according to an example of practicing of the present invention. A half of a sound absorbing body 1 used in practicing the invention consists of a sound insulation plate 2 that is an inner plate produced by forming a hard material such as a steel plate (see FIG. 2) and a sound absorbing member 6 in which a sound absorbing material 4 such as glass wool is incorporated, by use of holding members 5, inside of a perforated plate 3 such as a polycarbonate plate having punched-out small holes (see FIG. 4).

Although the illustrated sound absorbing member 6 consists of the perforated plate 3 and the sound absorbing material 4 such as glass wool, the invention imposes no limitations on the materials of the sound absorbing member 6. For example, it may be made only of a porous sintered metal, foamed aluminum or foamed ceramics (i.e., without using the perforated plate 3).

Figure 2:
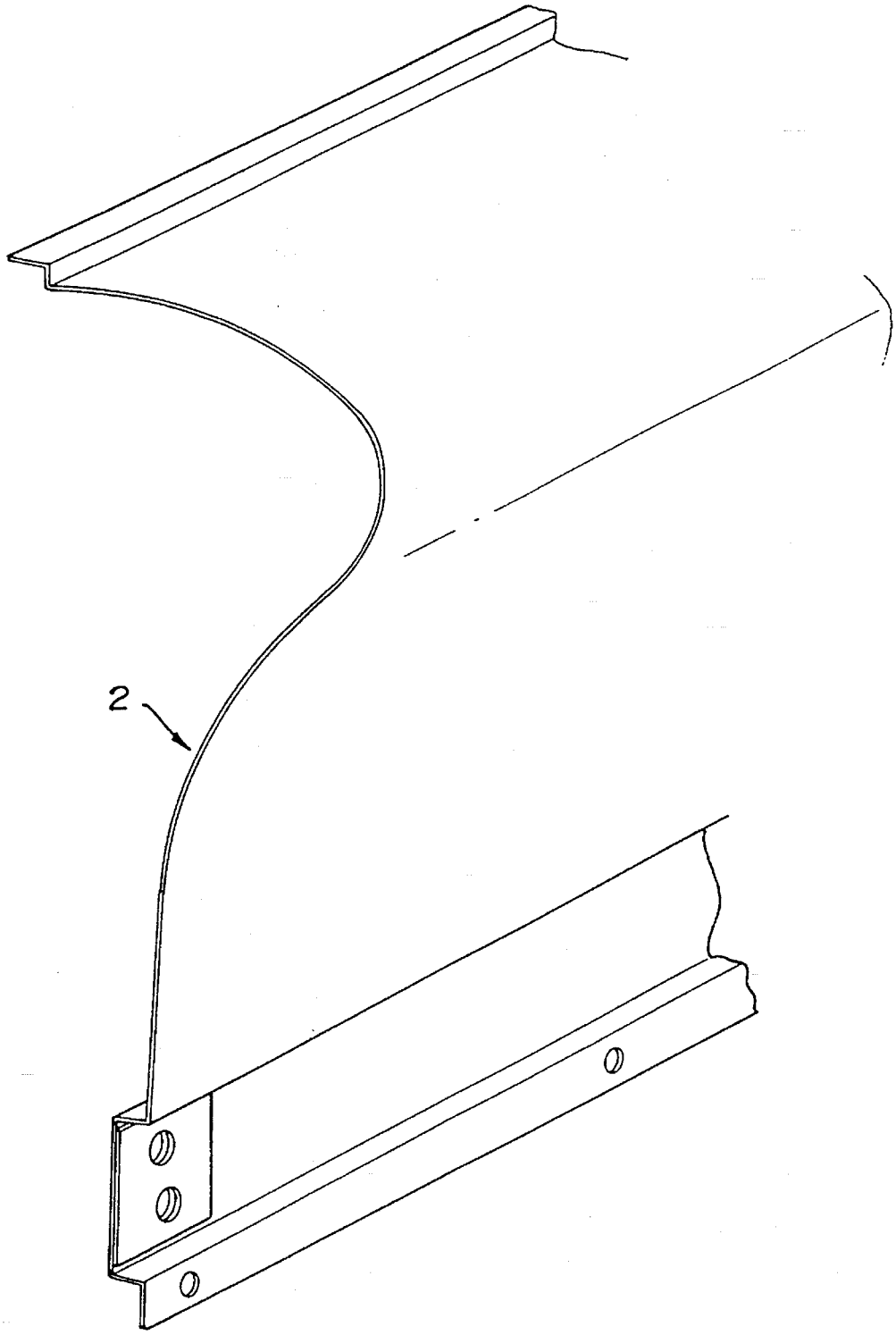
FIG. 2 is a perspective view of a sound insulation plate.

As shown in FIGS. 1 and 2, the sound insulation plate 2 and the sound absorbing member 6 are so formed that a cross-section generally assumes a "?" shape, and two sets of sound insulation plate 2 and sound absorbing member 6 are connected to each other so as to be symmetrical with respect to a vertical plane. However, the invention is not limited to this structure, but the sound insulation plate 2 and the sound absorbing member 6 may be so formed that a cross-section assumes a semi-circular or semi-elliptical shape as long as the two sets of sound insulation plate 2 and sound absorbing member 6 can prevent diffraction of noise sound when they are connected to each other so as to be symmetrical.

Figure 5:
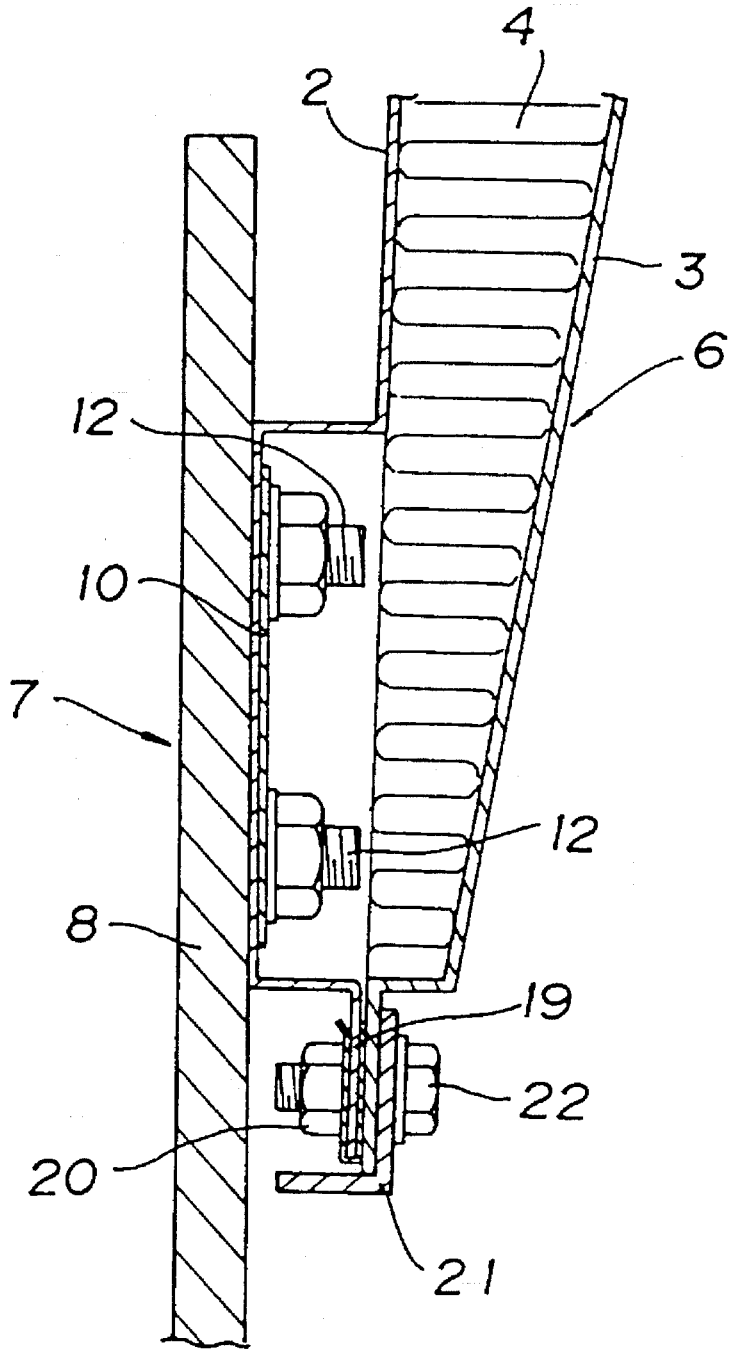
FIG. 5 is en enlarged view of a portion indicated by arrow Z in FIG. 1.

As shown in FIGS. 1 and 5, in the first step of the invention, bottom portions 10 and 11 of the sound insulation plates 2 are fixed, with weld bolts of side plates 8 and 9, to the outer faces of the side plates 8 and 9 of each of shaped steel members 7 (in the illustrated example, H-shaped steel members) that extend upward from the top face of a sound insulation wall (not shown) and are arranged at predetermined spans. (One of the side plates 8 and 9 faces a sound source.) The sound insulation plates 2 may be fixed to the shaped steel members 7 with their length being so adjusted as to conform to the span of the shaped steel members 7. That is, the sound insulation plates 2 need not be formed preliminarily into a predetermined length.

Figure 3:
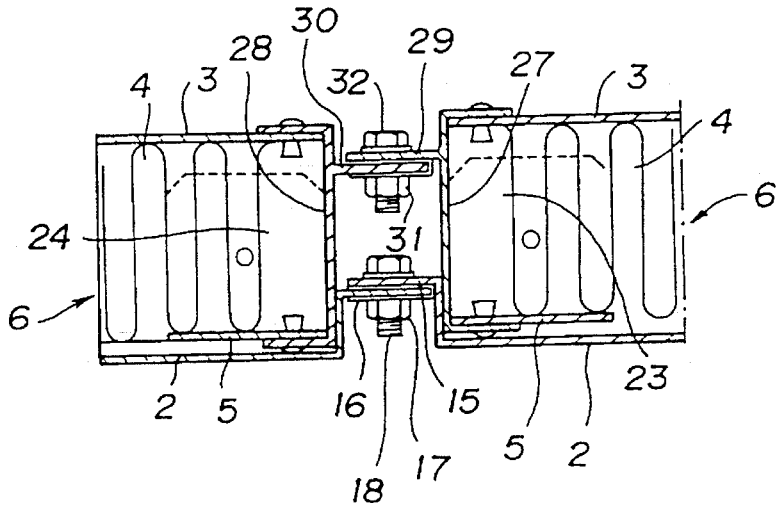
FIG. 3 is a sectional view taken along line X—X in FIG. 1.

In a top portion 14 of the sound absorbing body 1 (see FIG. 1), extensions 15 and 16 of the sound insulation plates 2 are placed on each other, and connected to each other by use of a clip nut 17 that is attached to the extension 16 and a bolt 18 (see FIGS. 1 and 3). Then, the resulting assembly is placed onto the shaped steel members 7 from above, and fixed thereto (see FIG. 1).

Subsequently, in the second step, the sound absorbing members 6 are attached to the outer surface of the sound insulation plates 2 fixed to both sides of the shaped steel members 7.

In the illustrated example (FIGS. 1 and 5), each sound absorbing member 6 is fixed to a bottom extension plate 19 of the sound insulation plate 2 by engaging, through a water draining plate 21, a bolt 22 with a clip nut 20 that is attached to the extension plate 19. But the invention is not limited to this fixing structure.

As shown in FIGS. 1 and 3, in the top portion 14 of the sound absorbing body 1, connecting metal fittings 27 and 28 are fixed to opposed end portions 23 and 24 of the sound absorbing members 6 through the holding members 5. Extensions 29 and 30 of the metal fittings 27 and 28 are placed on each other, and connected to each other by use of a clip nut that is attached to the extension 30 and a bolt 32. Then, as described above, the connected sound absorbing members 6 are placed, from above, onto the sound insulation plates 2 that are fixed to the shaped steel members 7, and then fixed to the sound insulation plates 2.

Figure 4:
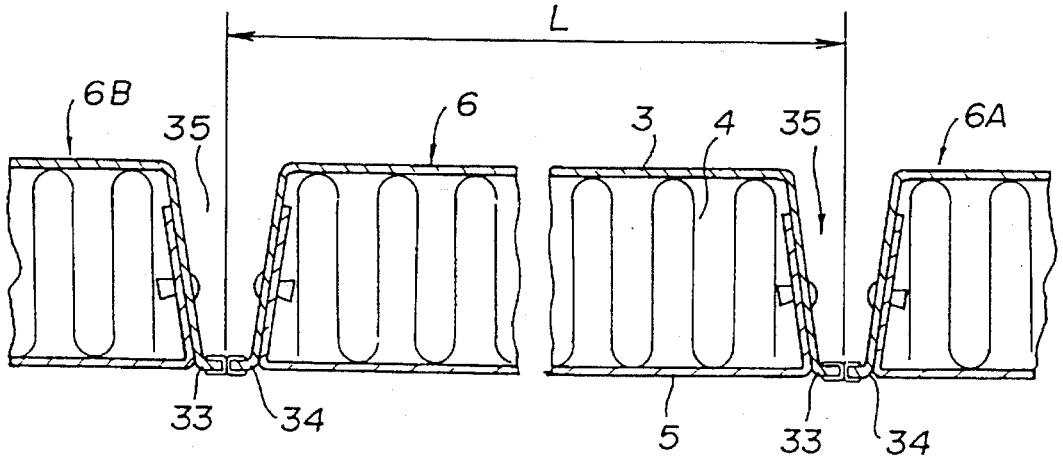
FIG. 4 is a sectional view taken along line Y—Y in FIG. 7 and showing an arrangement of sound absorbing members.

The sound absorbing members 6, each of which is so formed as to have a predetermined length L that is irrelevant to the span of the shaped steel members 7, are attached, as described above, to the outer surfaces of the respective sound insulation plates 2 that are fixed to the shaped steel members 7 so that flanges 33 and 34 are opposed to each other (see FIG. 4). As a result of the opposed arrangement of the flanges 33 and 34, continuous gaps 35 develop generally vertically between the adjacent ones of the sound absorbing members 6, 6A and 6B (see FIG. 6).

Figure 6:
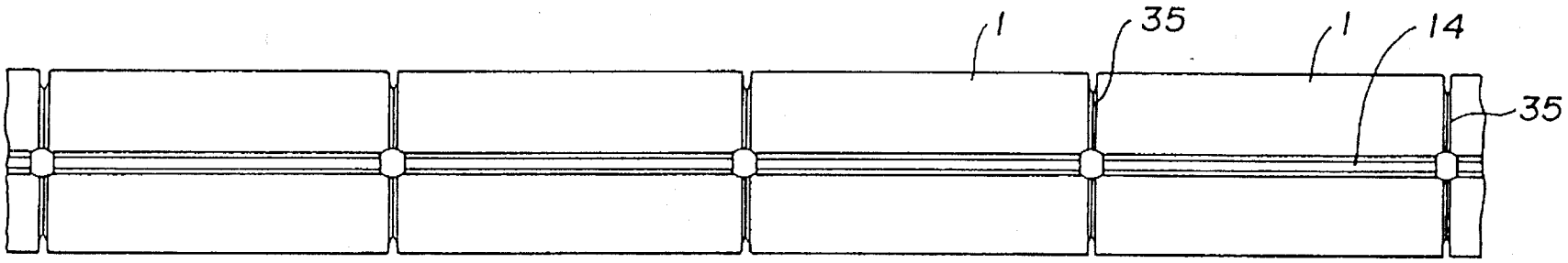
FIGS. 6 and 7 are a plan view and a side view, respectively, showing an arrangement of the sound absorbing members that are fixed to a top portion of a sound insulation wall.
Figure 7:
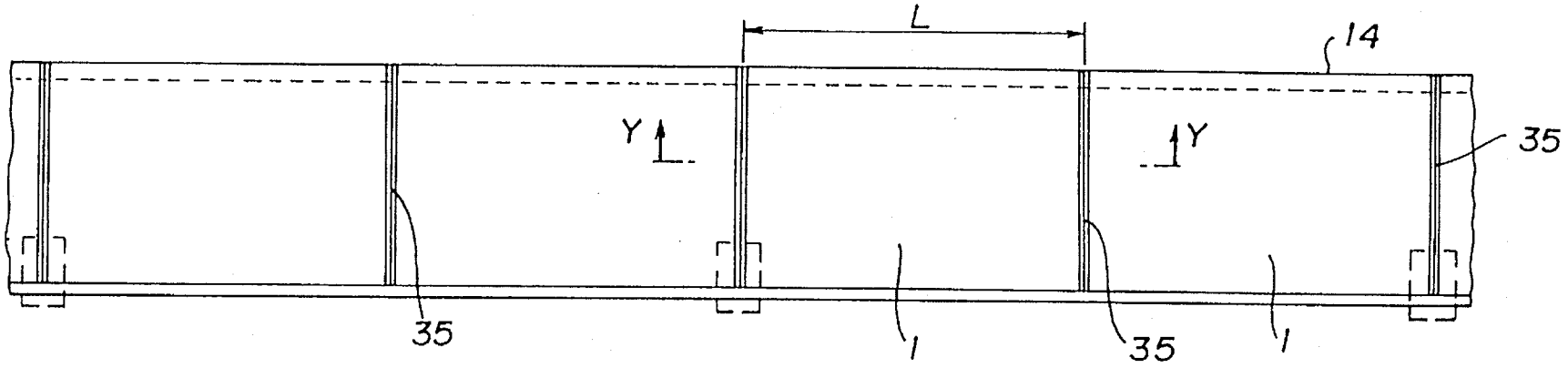
Figure 8:
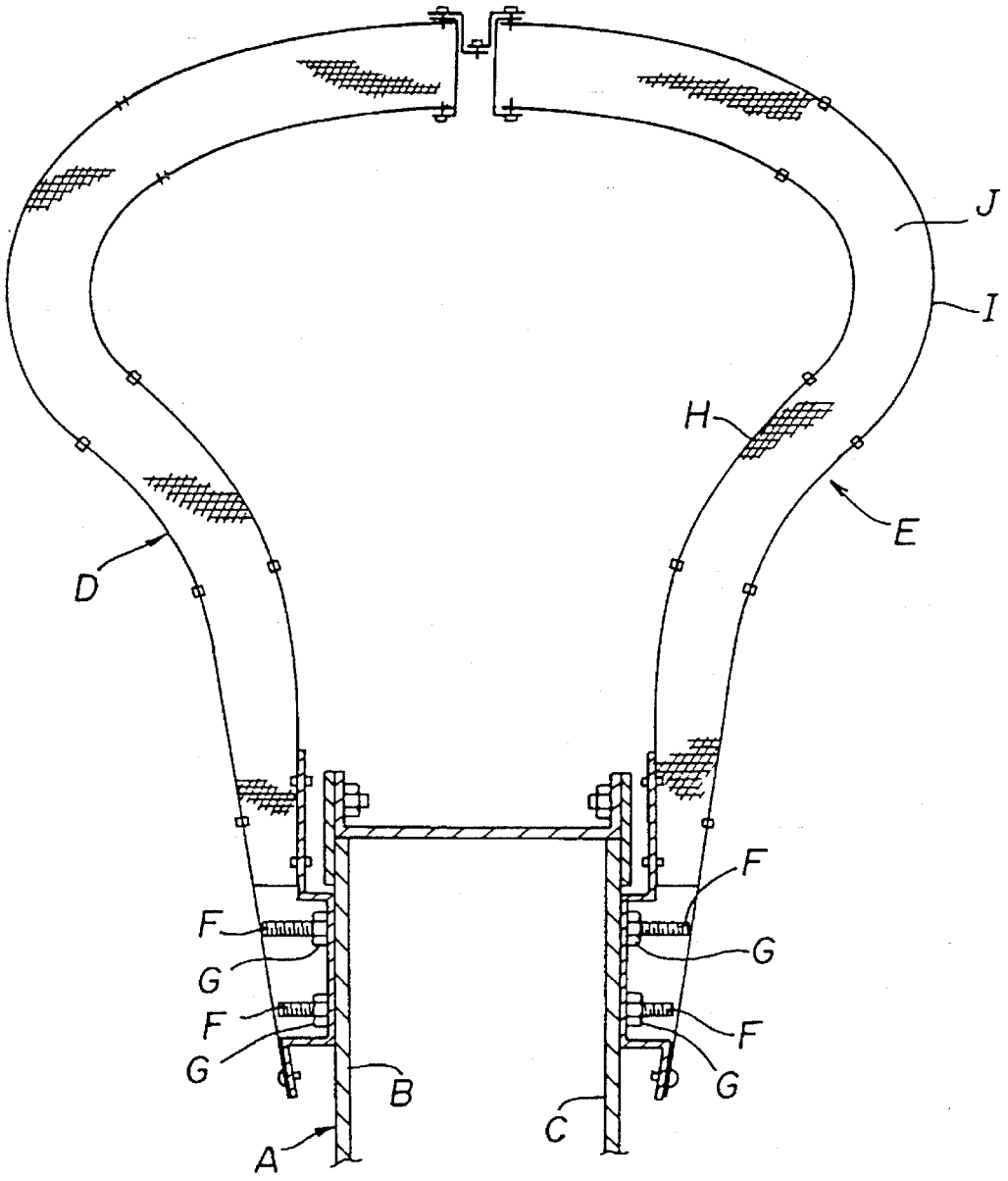
FIG.8 PRIOR ART
FIG. 8 is a sectional view showing a conventional fixing structure of a sound absorbing body.

FIGS. 6 and 7 are a plan view and a side view, respectively, showing an arrangement of the sound absorbing bodies 1. It is clearly seen from these figures that the gaps 35 have a remarkable effect in design. Since the length L of the individual sound absorbing members 6 is set at a predetermined value that is irrelevant to the span of the shaped steel members 7, the completely assembled sound absorbing bodies 1 are always uniformly arranged and exhibit an orderly appearance even if the span of the shaped steel members varies from one installation site to another.

As mentioned above, the sound absorbing member 6 is not limited to the combination of the perforated plate 3 and the sound absorbing material 4 such as glass wool, but may be a formed product made only of a porous sintered metal, foamed aluminum or foamed ceramics.

As described above, in the first step of the invention, only the sound insulation plates, which will be later hidden inside the sound absorbing bodies, are fixed to the shaped steel members at the intervals equal to the spans of the shaped steel members. Therefore, even if the span of the shaped steel members varies from one installation site to another, it is sufficient to prepare the sound insulation plates whose length conforms to the span of the shaped steel members, or to cut the sound insulation plates at an installation site so that their length conforms to the span of the shaped steel members. This will improve the ease of the operation of fixing the sound insulation plates.

After the fixing of the sound insulation plates, in the second step, the sound absorbing members which have been formed into a predetermined shape and length that are irrelevant to the span of the shaped steel members are attached to the outer surfaces of the sound insulation plates. Therefore, the sound absorbing members having standard dimensions (including the length) can be used universally. This will not only improve the ease of the operation of attaching the sound absorbing members, but also enable provision of a sound absorbing body assembly having an orderly appearance.

Further, the sound absorbing members can be attached simply by placing from above the right-side and left-side sound absorbing members that have been connected at the top end portion onto the sound insulation plates, and fixing the sound absorbing members to the sound insulation plates at the bottom end portions. This will further improve the ease of the operation of attaching the sound absorbing members.

What is claimed is:

1. A method of installing, on a top portion of a sound insulation wall, sound absorbing bodies that comprise right and left halves, each of which comprises sound insulation plates made of a hard material and sound absorbing members, the right and left halves assuming a generally symmetrical shape with respect to a vertical plane when installed, said method comprising the steps of:

fixing the sound insulation plates to right and left side plates of H-shaped steel members extending upward from the top portion of the sound insulation wall at intervals that are equal to arrangement spans of the H-shaped steel members; and attaching the sound absorbing members that have been formed into a predetermined shape and predetermined length to outer surfaces of the sound insulation plates, said predetermined length being set arbitrarily and independent of the arrangement spans of the H-shaped steel members.

2. The method of claim 1, wherein the sound absorbing members attaching step comprises:

connecting a pair of sound absorbing members that have been formed into the predetermined shape and length at a top end portion thereof;

placing the connected pair of sound absorbing members onto the sound insulation plates from above; and fixing bottom end portions of the connected pair of sound absorbing members to bottom end portions of the sound insulation plates.

3. The method of claim 1, wherein each of the sound absorbing members comprises an outer perforated plate and a sound absorbing material attached to the perforated plate.

4. The method of claim 3, wherein the perforated plate is a polycarbonate plate having punched-out holes.

5. A sound absorbing body assembly installed on a top portion of a sound insulation wall, said assembly comprising:

sound insulation plates made of a hard material, and fixed to right and left side plates of H-shaped steel members extending upward from the top portion of the sound insulation wall at intervals that are equal to arrangement spans of the H-shaped steel members; and sound absorbing members having a predetermined shape and length that is arbitrarily set independent of the arrangement spans of the H-shaped steel members, and attached to outer surfaces of the sound insulation plates;

wherein the sound insulation plates and the sound absorbing members constitute the sound absorbing body assembly comprising right and left halves that are generally symmetrical with respect to a vertical plane.

6. The sound absorbing body assembly of claim 5, wherein a pair of sound absorbing members are connected to each other at a top end portion thereof, and their bottom end portions are fixed to bottom end portions of the sound insulation plates.

7. The sound absorbing body assembly of claim 5, wherein each of the sound absorbing members comprises an outer perforated plate and a sound absorbing material attached to the perforated plate.

8. The sound absorbing body assembly of claim 7, wherein the perforated plate is a polycarbonate plate having punched-out holes.

9. The sound absorbing assembly of claim 5, wherein adjacent ones of the sound absorbing members are opposed to each other through flanges extending therefrom.

* * * * *